US006138294A

United States Patent [19]

Desjoyaux et al.

[11] Patent Number: 6,138,294

[45] Date of Patent: Oct. 31, 2000

[54] COOLING DEVICE FOR COMPACT PUMPING AND FILTRATION ASSEMBLY FOR SWIMMING POOL

[75] Inventors: Jean Louis Desjoyaux, L'Etrat; Pierre Louis Desjoyaux, La Fouillouse; Catherine Jandros, L'Etrat, all of France

[73] Assignee: Piscines Desjoyaux S.A., La Fouillouse, France

[21] Appl. No.: 09/355,161

[22] PCT Filed: Jan. 29, 1998

[86] PCT No.: PCT/FR98/00163

§ 371 Date: Jul. 22, 1999

§ 102(e) Date: Jul. 22, 1999

[87] PCT Pub. No.: WO98/35116

PCT Pub. Date: Aug. 13, 1998

[30] Foreign Application Priority Data

Feb. 7, 1997 [FR] France ..... 97 01642

[51] Int. Cl.[7] ..... E04H 4/00

[52] U.S. Cl. ..... 4/509; 4/496; 4/507; 210/169; 210/416.2

[58] Field of Search ..... 4/496, 507, 509, 4/510; 210/169, 195.1, 416.2

[56] References Cited

U.S. PATENT DOCUMENTS 4,749,477 6/1988 McGregor ..... 4/509

FOREIGN PATENT DOCUMENTS 2554857 5/1985 France .
2715865 8/1995 France .
2725634 4/1996 France .

*Primary Examiner*—Henry J. Recla
*Assistant Examiner*—Tuan Nguyen
*Attorney, Agent, or Firm*—Wall Marjama & Bilinski

[57] ABSTRACT

Apparatus for pumping and filtering water from a swimming pool that includes a caisson that is divided into three compartments. A filtering unit is contained in one compartment (A) and contains pool water to be filtered. An adjacent compartment (B) contains a pump having a inlet connected to the filtering unit. Compartment (B) communicates with a third compartment (C). A cover encloses the three compartments and has perforations that permit cooling air to enter compartment (C) and thus pass into compartment (B) to cool the pump. Water passing into compartment (C) is passed to a sanitary drain.

12 Claims, 5 Drawing Sheets

COOLING DEVICE FOR COMPACT PUMPING AND FILTRATION ASSEMBLY FOR SWIMMING POOL

BACKGROUND OF THE INVENTION

The invention relates to the technical field of means for filtering, in particular, the water in a swimming pool basin.

It is known, in order to filter the water in a swimming pool basin, to use units which combine the functions of a traditional system: specifically, in essence, the pumping of the water, the filtration of the water and its delivery to the swimming pool basin. In essence, these compact units comprise two separate parts.

One of these parts is intended to be submerged in the water of the swimming pool basin and accommodates the filtration means, of any known and appropriate type. The other part is situated outside the swimming pool basin and accommodates at least one suction and delivery pump. Connecting pipework is provided between the two parts to link the filtration means to the pumping means. Furthermore, the part submerged in the water of the swimming pool basin exhibits, in general, at least one nozzle for delivery of the aspirated water. Each of the parts constitutes a caisson, the said parts being protected by a lid. Similarly, these two parts may be independent of one another and connected by any known means to form a single unit, or alternatively these two parts may form, by molding or any other manufacturing method, a single compact unit.

On the basis of this concept, two forms of embodiment are essentially identifiable.

As is apparent from the teaching of patent FR 8318248, of which the present applicant is also the proprietor, the unit relates to a compact block constituting, transversely, a straddler in the shape of an inverted U in order to be arranged astride the edge of the swimming pool. Alternatively, as is apparent for example from the teaching of patent FR 9412773 of which the present applicant is also the proprietor, the compact unit may directly form a filtering panel or set of steps, in that the part intended to be submerged in the water of the basin of the swimming pool is designed to be coupled directly to the other panels constituting the basin.

As previously stated, pipework is provided between the two filtration and pumping compartments. Whatever the embodiment, the two filtration and pumping compartments must be separated, in particular at the level of the connecting pipework, by arrangements preventing the penetration of the water by overflow and/or splashing into the pumping compartment, given that it is not acceptable for the pumping compartment to receive, even if only by accident, some of the water from the basin of the swimming pool. Furthermore, it is necessary to create a natural or forced ventilation system in the pumping compartment to enable the pump or pumps to operate under satisfactory conditions, avoiding any overheating effect.

For this reason, and also having regard to the fact that the pumping compartment may not be in direct communication with the open air, in view of adverse weather, it is necessary to provide, in the area of separation between the two compartments, a slit or the like capable of allowing the passage of a sufficient film of air to allow the ventilation of the pumping compartment. The presence of this film of air does not, therefore, allow the two compartments to be separated in a totally leaktight manner. Under these conditions, it is impossible fully to exclude the risk, all be it reduced, that the pumping compartment may accidentally receive some of the water contained by the submerged filtration compartment.

This problem is all the more genuine in the case of a filtration panel where the level of the water in the submerged compartment is much closer to the separation between the two compartments and, consequently, much closer to the slit for the passage of recycled air. It should also be noted that these arrangements do not allow genuine circulation of the air, which tends to be confined.

SUMMARY OF THE INVENTION

The object of the invention is to remedy these disadvantages in a simple, reliable, efficacious and rational manner.

The technical problem which the invention proposes to solve is that of having improved leaktightness between the two filtration and pumping compartments in order to avoid any accidental risk of the passage of water between the two compartments, while also having the object of being able to provide cooling, or more precisely ventilation, of the pumping compartment.

In order to solve such a problem, a cooling device has been designed and developed which is applicable in particular to a compact pumping and filtration unit for a swimming pool basin comprising, in the known manner, two distinct parts, one of which is submerged in the water and accommodates, in particular, at least one filtering member, at least one delivery nozzle and pipework for connection to the second part which is situated outside the basin and which accommodates at least one suction and delivery pump. According to the invention, the unit is notable in that:

- the two parts are separated in a leaktight or virtually leaktight manner,
- the part accommodating the pump is in communication with at least a third part,
- each of the parts constitutes a caisson, the said parts being protected by a lid,
- the lid or lid part corresponding to the third part possesses arrangements to establish communication between this third part and the outside air.

In other words, taking account of the features on which the invention is based, the technical problem which the invention proposes to solve is no longer that of controlling any passage of water between the suction compartment and the pumping compartment but that of causing the reentry of air passing to the exterior while avoiding any risks of the passage of water coming from the exterior, in other words, in essence, rain water, snow melt, etc.

In order to solve the stated problem of ensuring ventilation of the pumping compartment and, consequently, establishing communication between the third part of the compact unit and the outside air, the arrangements of the lid or the lid part take the form of a zone possessing a plurality of open-ended perforations.

In order to solve the stated problem of preventing any accidental passage of rain water, or other water, into the pumping compartment, the third part and the part accommodating the pump or pumps are separated by arrangements allowing the passage of air while preventing the passage of any water contained in the said third part.

With this object in mind, various forms of embodiment may be envisaged.

For example, the separation arrangements take the form of an inclined surface, or alternatively the separation arrangements take the form of a hollow empty space partially sealed by a rib of the lid in order to form a chicane with a water evacuation system in line with the chicane.

Similarly, in order to avoid any risk of liquid running down the inner face of the lid, the latter possesses, in the vicinity of the pumping compartment, a transverse rib acting as a drip stone.

In order to solve the stated problem of achieving a single compact unit, the third part is arranged in the same plane as the part accommodating the pump or pumps and in a substantially parallel manner, acting as a chute.

Advantageously, the bottom of the third part is pierced for the drainage of any water which it may contain. The bottom of the third part is connected to a drainage pipe.

Again with a view to lowering the temperature in the pumping compartment, it appeared useful to establish direct communication between the air intake of the motor and the outside. In order to solve this problem, communication is established between the third part and the suction and delivery pump by means of a tubular member, one of whose ends opens out from the said parts while the other end possesses arrangements for coupling to the air intake of the motor of the pump.

Taking these arrangements into account, the result is that the air is aspirated directly from the outside in order to be sent to the motor of the suction pump, so that the resulting hot air is immediately discharged to the outside, thus ensuring perfect heat exchange.

In order to solve the stated problem of lowering the temperature within the caisson accommodating the suction and delivery pump, the zone of the third part into which the tubular member opens possesses transverse and lateral walls shaped in order to form a leaktight enclosure.

Advantageous results are obtained if the transverse wall is situated approximately centrally in order to divide the third part into two very substantially equivalent zones.

Taking all these features into account, and with a view to reducing the manufacturing cost substantially while retaining the objective of obtaining a single compact unit, the latter is achieved by rotational molding, it being understood of course that other methods may be used: plastics injection molding, polyester spraying or thermoforming.

BRIEF DESCRIPTION OF THE DRAWING

The invention is explained below in greater detail with the aid of the figures of the attached drawings, in which.

DESCRIPTION OF THE INVENTION

Figure 1:
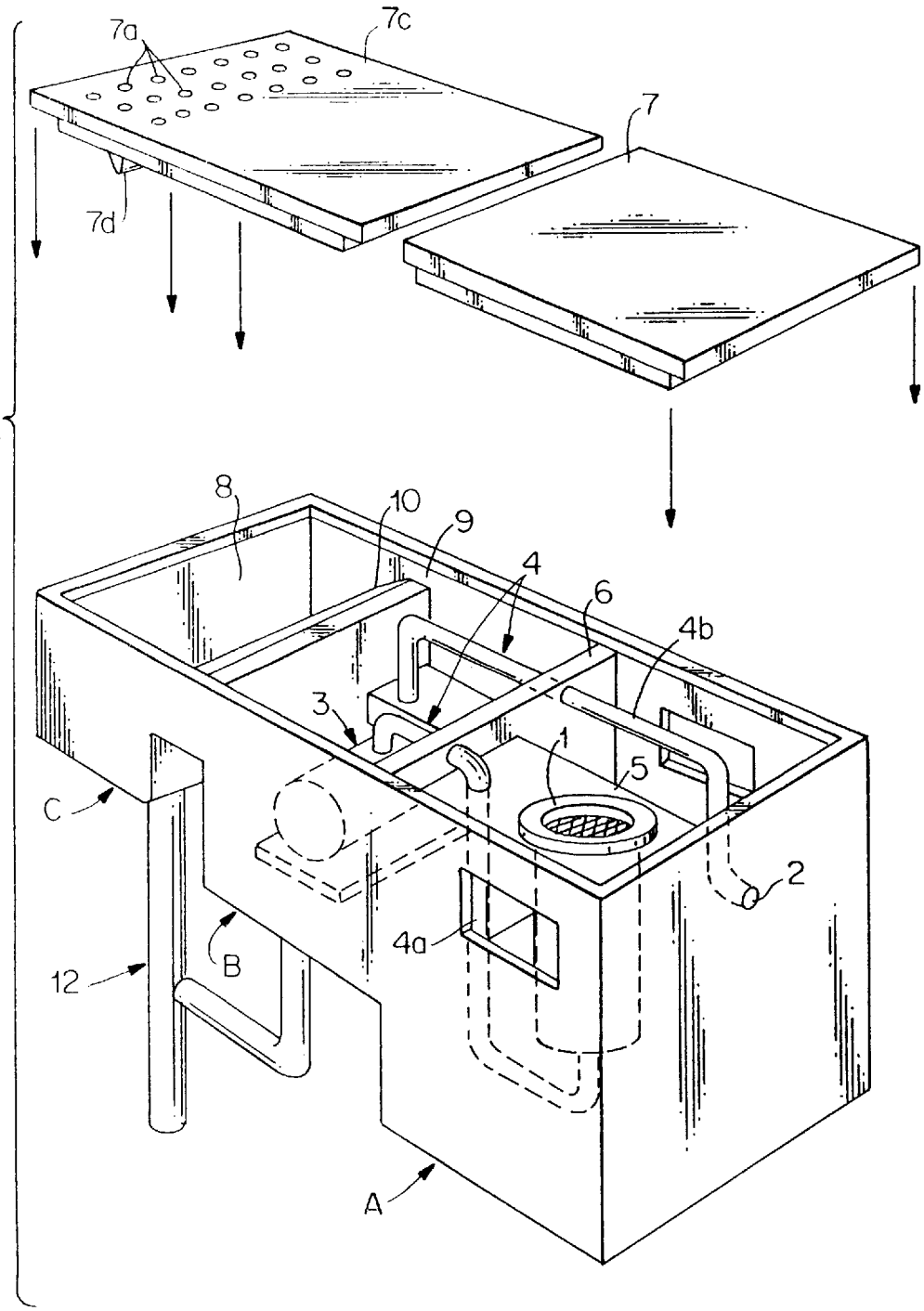
FIG. 1 is a perspective view of an example of an embodiment of the compact pumping and filtration unit, the said unit being shown before the lids are placed in position.
Figure 2:
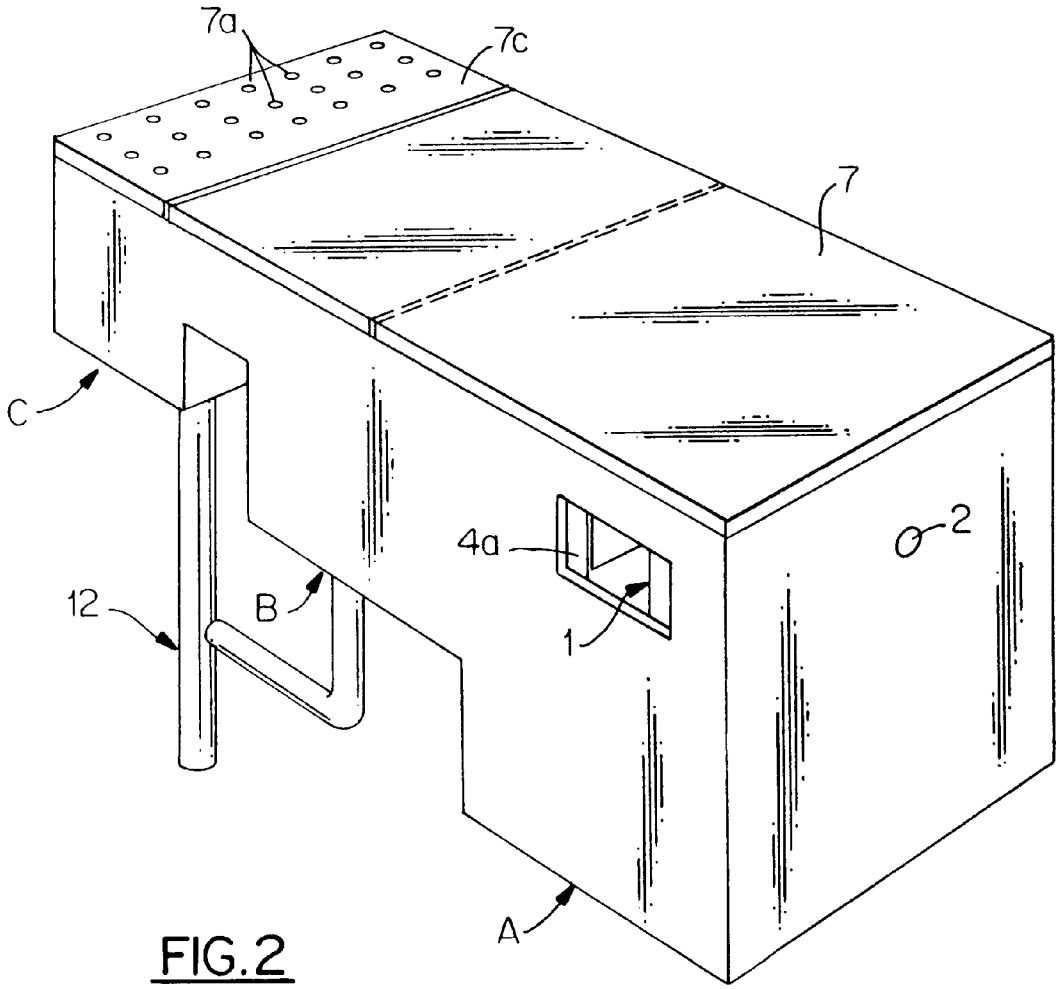
FIG. 2 is a view corresponding to FIG. 1 of the compact unit after the lids are placed in position.

For clearer understanding of the remainder of the description, it will be recalled that the compact pumping and filtration unit comprises two distinct parts (A) and (B). Part (A) directly constitutes a caisson and is intended to be submerged in the water of the basin of the swimming pool. Part (A) accommodates at least one filtering member (1) and at least one delivery nozzle (2). Furthermore, the front face and/or the lateral faces of part (A), submerged in the water, possess, in a manner fully familiar to the person skilled in the art, apertures known under the name of skimmers for the passage of the water coming from the basin of the swimming pool. The other part (B) likewise constitutes a caisson situated outside the basin of the swimming pool and accommodates at least one suction and delivery pump (3). Pipework (4) provides the connection between the filtration compartment and the pumping compartment.

The filtration member (1) is disposed in a support (5) whose bottom is connected via a strainer by means of pipework (4*a*) to the pump (3). Additional pipework (4*b*) provides for the delivery of the aspirated water into the basin of the swimming pool in conjunction with, in particular, the delivery nozzle (2). These technical filtration arrangements are not described in detail, being fully familiar to the person skilled in the art, and may be the subject of various alternative embodiments.

Similarly, the two parts (A) and (B) are connected one to the other either directly or detachably, in order to form a single compact unit. The unit thus formed is shaped so as to be able to be arranged astride the edge of the walls of the basin of the swimming pool, or so as to form directly a filtration panel or steps, part (A) exhibiting, in this case, any arrangement enabling it to be fixed in combination and in alignment with the other panels forming the basin of the swimming pool.

According to a basic feature of the invention, the two parts (A) and (B) are separated, in particular at the level of the pipework (4), in a leaktight manner, for example by a partition (6). The part (B) accommodating the pump (3) is in communication with at least one third part (C). A lid (7) seals the two parts (C) and (A), while a lid (7*c*) seals the pumping compartment (B). Quite clearly, and without thereby departing from the scope of the invention, the lid (7) may be embodied in a plurality of members corresponding to each of the part (A), (B) and (C).

The lid (7), in particular, possesses arrangements for establishing communication between the third part (C) and the outside air. Advantageously, the lid possesses, in the region of this third part (C), a plurality of open-ended perforations (7*a*). This third part (C) is disposed in the same plane as the part (B) accommodating the pump or pumps (3) and in an essentially parallel manner, acting as a chute (8). This chute (8) is therefore in communication by at least one aperture (9) with the compartment of part (B) accommodating the pump or pumps.

Given that the chute (8) is in communication with the outside air, by means of the perforations (7*a*), there will be circulation of air within the pumping compartment and the free communicating space (9). This circulation of air enables the pump or pumps (3) to be cooled.

According to another feature, the chute (8) and the pump compartment (B) are separated by arrangements which, as indicated, allow the passage of the air while preventing the passage of the water that may be contained in the said chute.

Figure 3:
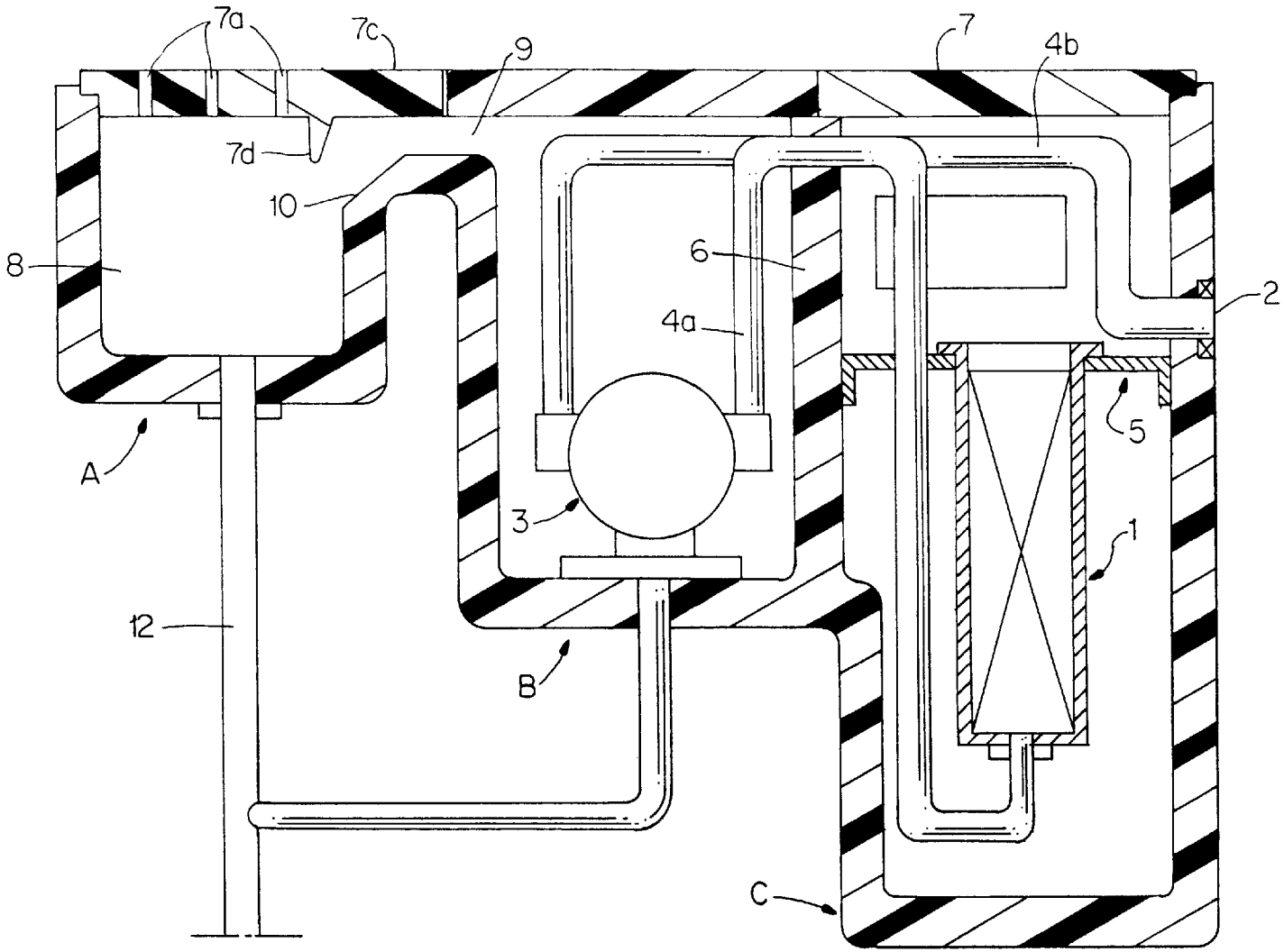
FIG. 3 is a view in longitudinal section of the unit according to a first embodiment.

In the example of the embodiment shown in FIG. 3, the separation between the chute (8) and the pumping compartment is provided by an inclined surface (10).

Figure 4:
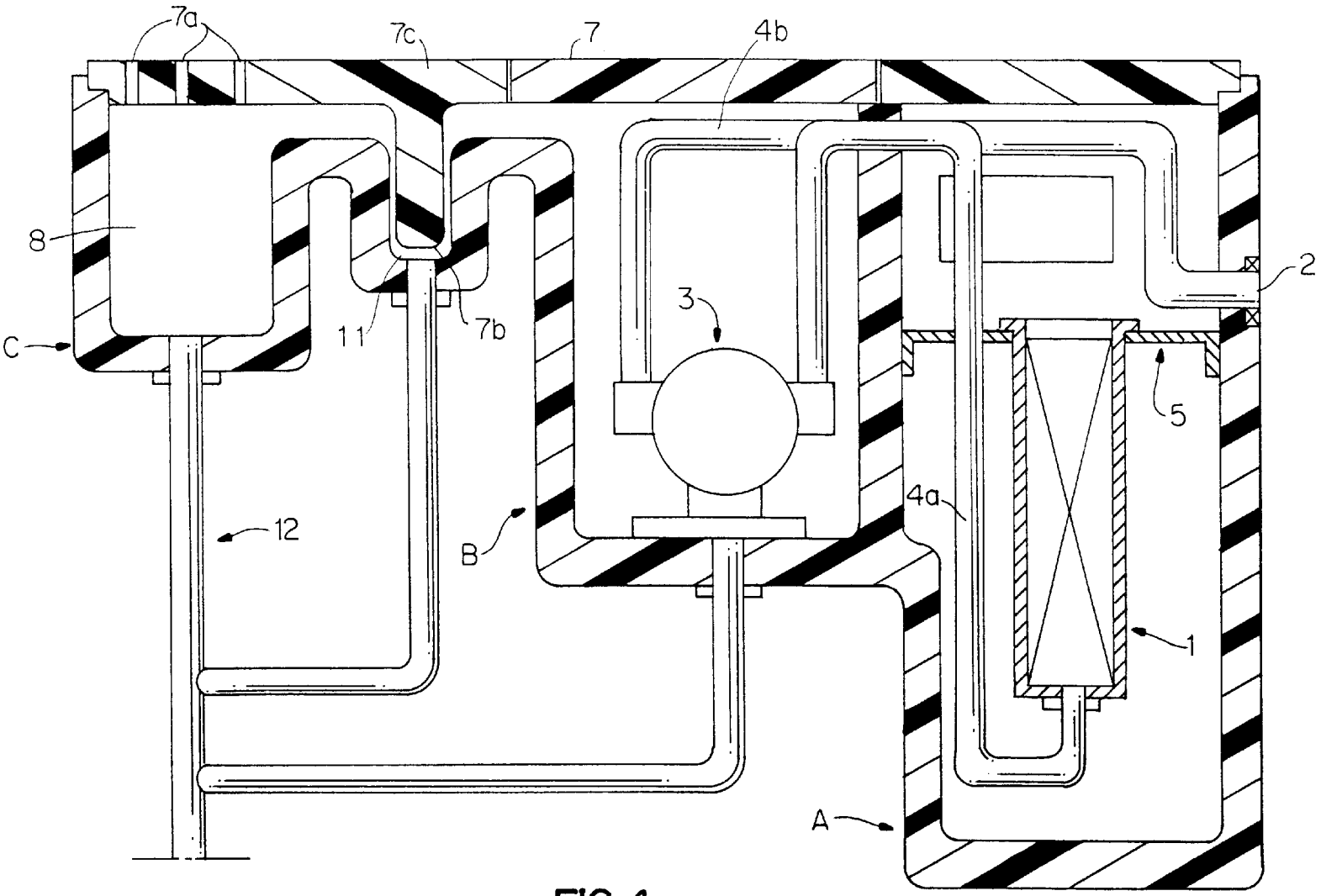
FIG. 4 is a view similar to FIG. 3, of another embodiment.

In the example of the embodiment shown in FIG. 4, the chute (8) is connected to the pumping compartment via a hollow empty space (11) intended to be partially sealed by a rib (7*b*) of the lid in order to form, in combination, a chicane.

In order to avoid any dripping effect on the inner face of the lid (7), the latter possesses transversely, over its entire width and in the vicinity of the separation from the pumping compartment, a rib (7*d*) acting as a drip stone.

The bottom of the third part (C) or chute (8) is pierced for the drainage of rain water or other water. Similarly, the bottom of the chute is linked to a duct (12) connected, for example, to the main drainage system. The same applies to the hollow part (11) accommodating the rib (7*b*).

Figure 5:
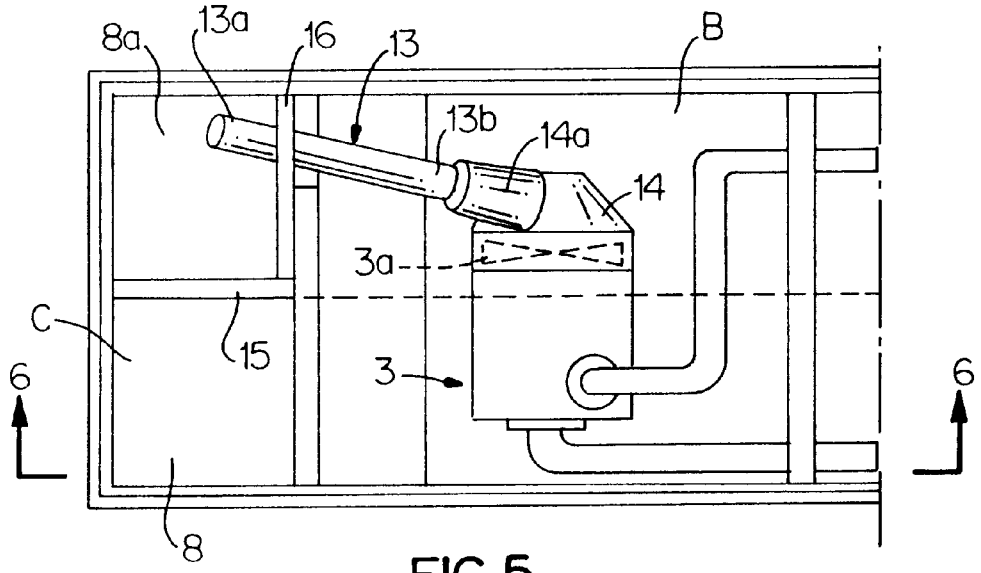
FIG. 5 is a view from above of the compact pumping and filtration unit showing the establishment of communication between the outside air and the motor of the suction and delivery pump, the lids being removed.
Figure 6:
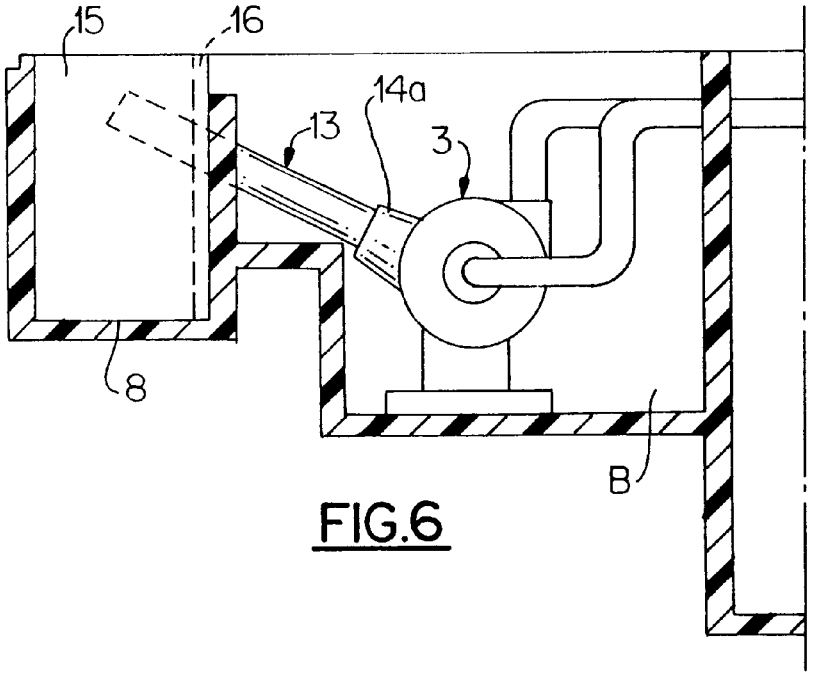
FIG. 6 is a view in longitudinal section taken along the line 6—6 in FIG. 5.

In order to reduce the temperature within the caisson (B) accommodating the pump (3), it appeared advantageous to establish direct communication between its motor (3*a*) and the outside air. To this end, and as shown in particular in FIG. 5, the third part (C), constituting the chute (8) in communication with the outside air via the perforations (7*a*) in the lid, is in communication with the pump (3) by means of a tubular member (13). One of the ends (13*a*) of the tubular member opens into the chute (8) and the other end (13*b*) has arrangements for coupling (14) to the air intake of the motor (3*a*) of the pump (3). For example, these arrangements (14) take the form of a bell-shaped space designed to cap the outer section of the corresponding part of the motor of the pump. This bell-shaped space (14) possesses a sleeve (14*a*) for the coupling of the end (13*b*) of the tubular member (13).

The zone (8*a*) of the chute into which the end (13*a*) of the tubular member (13) opens possesses transverse (15) and lateral (16) walls shaped to form a leaktight enclosure. Advantageously, the transverse wall (15) is situated very substantially at the center of the chute (8) in order to divide it into two very substantially equivalent zones (3*a* and 8*b*). The transverse wall (15) may be extended to divide the caisson (B) accommodating the suction and delivery pump (3) into two.

Taking these arrangements into account, it is clear that the air is aspirated directly from the outside in order to be sent to the motor (3*a*) of the pump, the air leaving the motor being immediately discharged to the outside, thus preventing it from stagnating within the caisson (B). In this manner, any abnormal rise in temperature within the caisson accommodating the suction and delivery pump is avoided. Various tests and measurements have shown that a temperature very substantially equal to the temperature of the outside air is obtained within the caisson (B).

In accordance with another feature, and taking the design arrangements into account, the compact unit according to the invention can advantageously be obtained by rotational molding, injection molding of plastic, thermoforming, polyester spraying, etc.

The advantages are clearly apparent from the description. In particular the possibility is emphasized and recalled of separating, in a leaktight manner, the pumping compartment from the filtration compartment, while allowing circulation of air to be achieved within the pumping compartment, with the reduced or nonexistent risk that the pumping compartment will be subjected to the action of rain water or other water, taking into account first the arrangements for the circulation of the air and secondly the high probability that the chute will never be filled with water or the like.

It is also noted that the establishment of communication between the motor of the pump and the outside air, under the conditions indicated, makes it possible significantly to reduce the temperature within the caisson accommodating said pump. Advantageously, this results in an increase in the service life of the motor and the elimination of any harmful effect on adjacent components, such as the transformer, which is subjected to the influence of temperature. Finally, it is noted that it is possible to reduce the power consumed by the motor, hence reducing costs.

What is claimed is:

1. Cooling device for compact pumping and filtration unit for a swimming pool basin comprising two distinct parts (A) and (B), one of which (A) is submerged in the water and accommodates at least one filtering member (1), at least one delivery nozzle (2) and pipework (4) for connecting to the second part (B) which is situated outside the basin and which accommodates at least one suction and delivery pump (3), wherein:

the two pans (A) and (B) are separated in a leaktight or virtually leaktight manner, the second part (B) accommodating the at least one pump is in communication with at least a third part (C) by arrangements allowing the passage of air while preventing the passage of any water contained in said third part, each of the parts (A), (B), and (C) constituting a caisson, each of said parts being protected by a lid (7), the lid (7) corresponding to the third part, and possessing arrangements to establish communication between the third part (C) and the outside air.

2. Device according to claim 1, wherein the arrangements of the lid (7) take the form of a zone possessing a plurality of open-ended perforations (7*a*).

3. Device according to claim 1, wherein the separation arrangements take the form of an inclined surface (10).

4. Device according to claim 1, wherein the separation arrangements between the second part (B) and the third part (C) take the form of a hollow empty space (11) partially sealed by a rib (7*b*) of the lid (7) in order to form, in combination, a chicane.

5. Device according to claim 4, wherein the bottom of the third part (C), the bottom of the second part (B), and the hollow space (11) are connected to a drainage pipe (12).

6. Device according to claim 1, wherein the third part (C) is arranged in the same plane as the second part (B) accommodating the at least one pump (3) and in a substantially parallel manner, acting as a chute (8).

7. Device according to claim 1, wherein the bottom of the third part is pierced for the drainage of any water which the third part may contain.

8. Device according to claim 1, wherein an inner face of the lid (7) of the third part (C) possesses transversely, in the vicinity of the separation from the second part (B), a rib (7*d*) acting as a drip stone.

9. Device according to claim 1, in which communication is established between the third part (C) and the at least one suction and delivery pump by means of a tubular member (13), one of whose ends (13*a*) opens into said third part while the other end (13*b*) possesses arrangements for coupling to an air intake of a motor (3*a*) of the at least one pump.

10. Device according to claim 9, wherein the zone of the third part into which the tubular member opens possesses transverse (15) and lateral (16) walls shaped in order to form a leaktight enclosure.

11. Device according to claim 10, wherein the transverse wall (15) is situated substantially centrally relative to the third part in order to divide the third part into two substantially equivalent zones (8*a*, 8*b*).

12. Device according to claim 10, wherein the transverse wall (15) is extended in order to separate the second part accommodating the at least one pump into two zones.

* * * * *

UNITED STATES PATENT AND TRADEMARK OFFICE

CERTIFICATE OF CORRECTION

PATENT NO. : 6,138,294
DATED : October 31, 2000
INVENTOR(S) : Desjoyaux et al.

It is certified that error appears in the above-identified patent and that said Letters Patent is hereby corrected as shown below:

CLAIMS

Claim 1, Column 6, Line 12, please delete the word "pans" and replace with the word --parts--.

Signed and Sealed this

Eighth Day of May, 2001

*Attest:*

Nicholas P. Godici

NICHOLAS P. GODICI

*Attesting Officer*

*Acting Director of the United States Patent and Trademark Office*